US006374593B1

(12) United States Patent
Ziegner

(10) Patent No.: US 6,374,593 B1
(45) Date of Patent: Apr. 23, 2002

(54) BURNER AND METHOD FOR REDUCING COMBUSTION HUMMING DURING OPERATION

(75) Inventor: Manfred Ziegner, Mülheim (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/646,612

(22) PCT Filed: Mar. 8, 1999

(86) PCT No.: PCT/DE99/00614

§ 371 Date: Sep. 20, 2000

§ 102(e) Date: Sep. 20, 2000

(87) PCT Pub. No.: WO99/49264

PCT Pub. Date: Sep. 30, 1999

(30) Foreign Application Priority Data

Mar. 20, 1998 (DE) ..... 198 12 322

(51) Int. Cl.[7] ..... F02K 3/14

(52) U.S. Cl. ..... 60/39.02; 60/737; 60/746; 60/748

(58) Field of Search ..... 60/748, 746, 737, 60/39.02

(56) References Cited

U.S. PATENT DOCUMENTS 5,966,937 A * 10/1999 Graves ..... 60/748

* cited by examiner

*Primary Examiner*—Charles G. Freay
*Assistant Examiner*—Ehud Gartenberg

(57) ABSTRACT

Combustion air or a combustion air/fuel mixture is supplied in a flow to a combustion process of a burner. A swirl, which is non-uniform in the peripheral direction, is imposed on the flow. A flow duct, in which is arranged a swirl device for imposing the swirl, is used for the supply of the combustion air or the combustion air/fuel mixture. As such, combustion oxcillations are reduced.

11 Claims, 2 Drawing Sheets

BURNER AND METHOD FOR REDUCING COMBUSTION HUMMING DURING OPERATION

This application is the national phase under 35 U.S.C. §371 of PCT International Application No. PCT/DE99/00614 which has an International filing date of Mar. 8, 1999, which designated the United States of America.

FIELD OF THE INVENTION

Gas turbine burner and method of reducing combustion oscillations during operation of such a burner.

The invention relates to a gas turbine burner. It also relates to a method for reducing combustion oscillations during the operation of such a burner.

The formation of combustion oscillations can occur during an operation of a gas turbine burner. This is also known under the concepts of "combustion chamber humming", "combustion chamber oscillations", "combustion-induced pressure pulsations", "oscillating combustion processes". The combustion oscillations are due to an interaction between the quantity supplied per unit time of combustion air/fuel mixture flowing in the flow duct of the burner. The mixture is ignited after entry into a combustion chamber and burns in a flame, with the momentary combustion conversion in the flame. Combustion conversion designates the quantity of combustion air/fuel mixture converted per unit time during a combustion process in a flame. Pressure fluctuations in the combustion chamber, which can lead to the formation of a stable pressure oscillation, can occur due to a change in the combustion conversion. In addition to an increased production of noise, the combustion oscillations cause an increased mechanical and thermal load on walls associated with the combustion chamber and on other parts belonging to the combustion system.

BACKGROUND OF THE INVENTION

A hybrid burner for a gas turbine is known from EP-0 580 683 B1. A hybrid burner has both a diffusion burner and a premixing burner. It can therefore be operated both in diffusion operation and in premixing operation. The premixing burner of the hybrid burner has an annular duct for the supply of combustion air or a combustion air/fuel mixture. Arranged in the annular duct, there is a swirl device for imposing a swirl on a flow, which is formed by the combustion air/fuel mixture supply or the combustion air in the annular duct. This swirl device is also designated as a swirl cascade. The diffusing burner of the hybrid burner is arranged coaxially within the annular duct of the premixing burner. The diffusion burner has a combustion air supply duct, which is designed as an annular duct and in which a fuel supply duct is coaxially arranged. The ducts of the diffusion burner open into a nozzle. In addition, the diffusion burner has a pilot burner, which is only necessary for the operation of the premixing burner, in its combustion air supply duct.

During a premixing operation of the hybrid burner, a combustion air/fuel mixture is supplied via the annular duct of the premixing burner and this mixture forms a flow, on which a swirl is imposed by means of the swirl cascade, in the annular duct. The swirling flow emerges from the premixing burner into a combustion process. The combustion process is stabilized by means of the pilot burner flame. During a diffusion operation of the hybrid burner, combustion air and fuel are respectively supplied via the combustion air supply duct and the fuel supply duct to a mixing process in the region of the nozzles of the diffusion burner. The combustion air/fuel mixture formed during the mixing emerges from the diffusion burner into a combustion process.

SUMMARY OF THE INVENTION

The object of the invention is to provide a gas turbine burner with a smaller tendency toward the formation of combustion oscillations. In addition, a method of reducing combustion oscillations in such a burner is to be provided.

In accordance with the invention, the object directed towards the gas turbine burner is achieved by the features of claim 1. Advantageous embodiments are the subject matter of subclaims which refer back to claim 1.

The invention is based on the knowledge that during an operation of such a burner in the flow duct, a flow of combustion air is formed to which fuel is admixed via fuel inlets for the formation of a combustion air/fuel mixture. The supply of fuel preferably takes place into a flow of combustion air which is uniform over the cross section of the flow duct. This has the advantage that the local mixture ratio of combustion air to fuel is essentially uniform over the cross section. The $NO_x$ content of the exhaust gas, which occurs due to the combustion of the combustion air/fuel mixture formed during the mixing process, can be influenced by a uniform mixture. Before the combustion air/fuel mixture is supplied to the combustion process, a swirl is preferably imposed on the flow in the flow duct by means of a swirl device in order to stabilize the combustion process. This swirl is usually uniform over the periphery of the flow duct in order not to impair the uniformity of the flow. Investigations have shown that as the flow of the combustion air/fuel mixture supplied to the combustion process by means of a burner becomes more uniform, the probability of the formation of combustion oscillations occurring during an operation of the burner in a combustion system increases.

The invention is therefore based on the idea of designing a gas turbine burner in such a way that the flow of a combustion air/fuel mixture which has been formed is made sufficiently non-uniform, by imposing a non-uniform swirl before the supply to a combustion system, for the excitation of combustion oscillations during an operation of the gas turbine burner in a combustion system to be at least substantially reduced. For this purpose, a swirl which is non-uniform in the peripheral direction is imposed on the flow of the combustion air/fuel mixture by means of a swirl device arranged in the flow duct.

Although it is known, from U.S. Pat. Nos. 5,388,536 and 5,415,114, to arrange vane-type deflection elements in the flow duct of a burner with different setting angles or at different spacings from one another, the intention of this was to create fuel-weak and fuel-rich flow duct regions in burners for steam generators in order to reduce the $NO_x$ content in the combustion gas.

The swirl device preferably has a plurality of swirl elements, each swirl element having a deflection surface. A main flow direction of the flow of the combustion air/fuel mixture, which can change as a function of the burner geometry, is defined on the basis of the geometry of the flow duct, which is configured as an annular duct. The deflection surfaces of the swirl elements each have an outlet angle, relative to the main flow direction, at the outlet end which is preferably different in the case of at least two directly adjacent swirl elements. This achieves the effect that after flowing through the swirl device, the flow emerges at two different angles, at least, in the peripheral direction, so that the swirl imposed is non-uniform in the peripheral direction. Also preferred is the configuration of each swirl element as a swirl vane. The burner can, for example, be configured as a hybrid burner of the gas turbine.

A plurality of swirl elements with the same outlet angles preferably form a swirl group and the swirl device has at least one such swirl group. The formation of the swirl device from a plurality of swirl groups is also preferred, with adjacent swirl groups having different outlet angles. The swirl device can then be formed from six swirl groups, for example, it being possible for each swirl group to have four swirl elements.

In order to reduce the quantity of the $NO_x$ compounds formed during a combustion process, it is desirable to supply fuel into a uniform flow of combustion air for the formation of a combustion air/fuel mixture intended for combustion. For this purpose, the burner preferably has a fuel inlet through which fuel can be supplied into the flow duct upstream of the outlet end. In this way, the fuel is supplied, before the swirl device, into a uniform flow of combustion air flowing in the supply duct.

The object directed toward the method is achieved, in accordance with the invention, by the features of claim 6. In this, a flow of a combustion air/fuel mixture or of combustion air has a swirl, which is non-uniform in the peripheral direction of the annular duct, imposed on it in a flow duct, which is configured as an annular duct, of the gas turbine burner.

The swirl device for imposing the swirl and the method for reducing combustion oscillations are explained in more detail by means of the embodiment example represented in the drawing.

BRIEF DESCRIPTION OF THE DRAWINGS

The drawings are shown diagrammatically, and not to scale in some cases while representing design and functional features used for the explanation, wherein.

DETAILED DESCRIPTION OF PREFERRED EMBODIMENTS

The designations for all the figures have the same meanings in each case.

Figure 1:
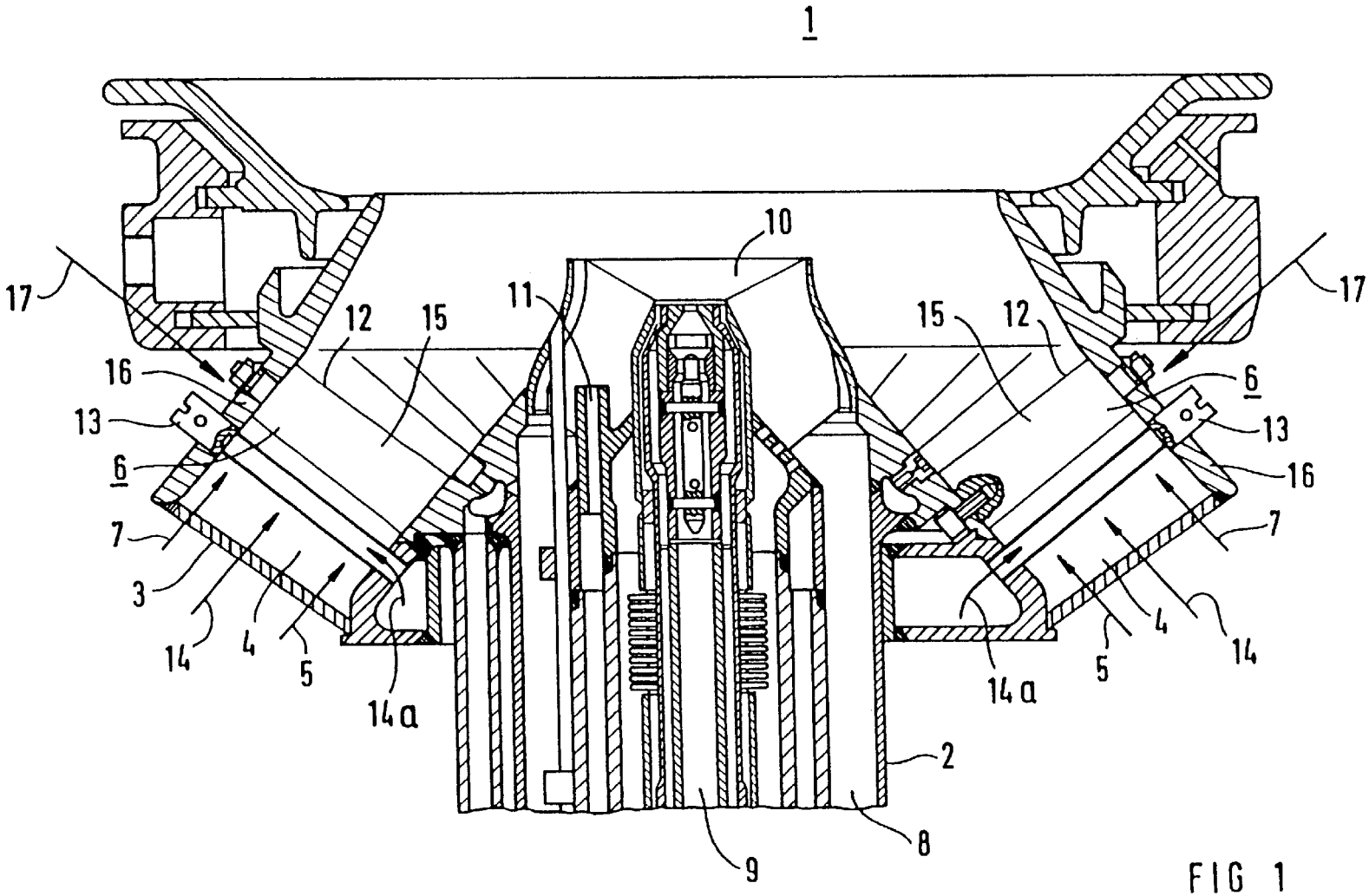
FIG. 1 shows a burner, embodied as a hybrid burner, for a gas turbine

FIG. 1 shows a burner 1, embodied as a hybrid burner 1, of a gas turbine (not shown in any more detail). The hybrid burner 1 has both a diffusion burner 2 and a premixing burner 3. The premixing burner 3 has an annular duct 4, with an outer wall 16, which is used for the supply of combustion air 5 or of a combustion air/fuel mixture 5. A swirl device 6, with an outlet end 12, which is used for imposing a swirl on a flow 7, is arranged in the annular duct 4, which flow 7 forms the combustion air/fuel mixture 5 or the combustion air 5 supplied in the annular duct 4. The swirl device 6 is also designated as a swirl cascade 6 in what follows. The swirl cascade 6 has a plurality of swirl elements 15, each of which is configured as a swirl vane. Fuel inlets 13, by means of which fuel 14 can be supplied to the annular duct 4 and can therefore, be mixed with the combustion air 5, are arranged upstream of the outlet end 12. The diffusion burner 2 of the hybrid burner 1 is arranged coaxially within the annular duct 4 of the premixing burner 3. The diffusion burner 2 has a combustion air supply duct 8, which is configured as an annular duct and in which a fuel supply duct 9 is coaxially arranged. The ducts 8 and 9 of the diffusion burner 2 open into a nozzle 10. In addition, the diffusion burner 2 has a pilot burner 11, which is provided for operation of the premixing burner 3, in its combustion air supply duct 8.

In a premixing operation of the hybrid burner 1, combustion air 5 is supplied via the annular duct 4 and this combustion air 5 mixes with fuel 14 supplied via the fuel inlets 13 to form a combustion air/fuel mixture. The combustion air/fuel mixture 5 forms a flow 7, with a local main flow direction 14, in the flow duct 2. A swirl, which is non-uniform in the peripheral direction, and with which the flow 7 leaves the swirl cascade 6 at the outlet end 12 and subsequently emerges from the annular duct 4, is imposed on the flow 7 when flowing through the swirl cascade 6. After it emerges, ignition and combustion of the combustion air/fuel mixture 5 take place. The combustion is stabilized by means of a flame of the pilot burner 11.

An advantageous feature of the embodiment described for the hybrid burner 1 is that, because of the non-uniform swirl exhibited by the flow 7 of the combustion air/fuel mixture 5 supplied to the combustion process, the outlet flow from the burner itself is non-uniform so that excitation of combustion oscillations is, at least, reduced. Also advantageous is the fact that the flow 7 exhibits a swirl by means of which the combustion process is stabilized. Upstream of the outlet end 12, the combustion air 5 forms a uniform flow 7 in the annular duct 4 of the premixing burner. Due to the arrangement of the fuel inlets 13, fuel 14 can be supplied and admixed upstream to the uniform flow 7 of the combustion air 5, so that a uniform mixing of combustion air 5 and fuel 14 can be achieved. This permits a reduction in the quantity of $NO_x$ compounds formed during the combustion process.

By analogy with the configuration of the swirl cascade 6 of the premixing burner 3, a swirl cascade arranged in the combustion air supply duct 8 can be embodied in such a way that, by this means, a swirl which is non-uniform in the peripheral direction can be imposed on a flow forming in the combustion air supply duct 8.

Figure 2:
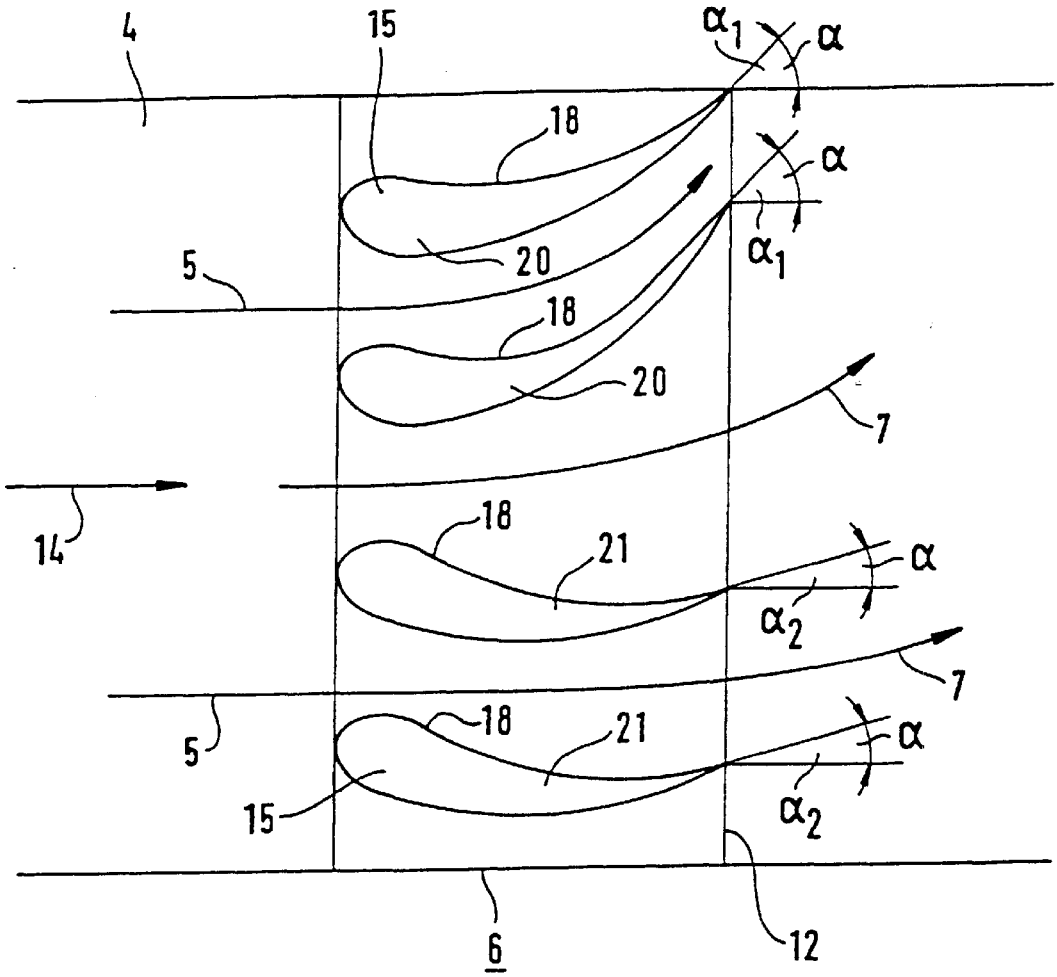
FIG. 2 shows a view, developed in the peripheral direction, of the swirl elements of the annular duct of the premixing burner.

A developed view, in the peripheral direction, of the swirl elements 15 of the annular duct 4 of the premixing burner 3, is shown in FIG. 2. The direction 17 at right angles to the outer wall 16 of the annular duct 4 and shown in FIG. 1 is selected as the direction of viewing. The swirl elements 15 each have a deflection surface 18. The deflection surfaces 18, together with the local main flow direction 14 (see also FIG. 1), each form an outlet flow angle $\alpha$. The deflection surfaces 18 of two adjacent swirl elements 20 and 21 have different outlet angles $\alpha_1$ and $\alpha_2$. Because of this, the flow 7 leaves the swirl cascade 6 at the outlet end 12 with a swirl which is imposed non-uniformly in the peripheral direction. In this arrangement, the swirl elements 20 and the swirl elements 21 are respectively combined in swirl groups which have the outlet angles $\alpha_1$ and $\alpha_2$.

The invention is distinguished by a burner in which combustion air or a combustion air/fuel mixture is supplied in a flow to a combustion process with a swirl which is non-uniform in the peripheral direction being imposed on the flow.

What is claimed is:

1. A gas turbine burner, comprising:

a flow duct, configured as an annular duct, adapted to guide a flow of one of combustion air and a combustion air/fuel mixture wherein the flow duct includes a swirl device for imposing a swirl on the flow, the swirl device being configured for the imposition of a swirl, which is non-uniform around the periphery of the annular duct, on the flow.

2. The gas turbine burner of claim 1, wherein each of a number of swirl elements of the swirl device includes a deflection surface with an outlet angle ($\alpha$) relative to the main flow direction at its outlet end, the outlet angles ($\alpha$) of at least two directly adjacent swirl elements being different.

3. The gas turbine burner as claimed in claim 2, wherein each swirl element is configured as a swirl vane.

4. The burner as claimed in claim 2, wherein the swirl device is formed from a plurality of swirl groups, each swirl group having a plurality of swirl elements with the same outlet angles ($\alpha_1$),($\alpha_2$), the swirl elements of adjacent swirl groups having different outlet angles ($\alpha_1$, $\alpha_2$).

5. The gas turbine burner as claimed in claim 1, wherein the gas turbine burner is embodied as a hybrid burner.

6. A method of reducing combustion oscillations during the operation of a gas turbine burner with a flow duct, configured as an annular duct, comprising:

imposing a swirl, which is non-uniform around the periphery of the annular duct, on a flow, in the annular duct, of one of a combustion air/fuel mixture and of combustion air; and supplying the flow to a combustion process.

7. The method as claimed in claim 6, further comprising:

feeding the fuel into the annular duct, by means of a fuel inlet, upstream of an outlet end of a swirl device arranged in the annular duct.

8. The burner as claimed in claim 3, wherein the swirl device is formed from a plurality of swirl groups, each swirl group having a plurality of swirl elements with the same outlet angles ($\alpha_1$),($\alpha_2$), the swirl elements having different outlet angles ($\alpha_1$, $\alpha_2$).

9. The gas turbine burner as claimed in claim 2, wherein the gas turbine burner is embodied as a hybrid burner.

10. The gas turbine burner as claimed in claim 3, wherein the gas turbine burner is embodied as a hybrid burner.

11. The gas turbine burner as claimed in claim 4, wherein the gas turbine burner is embodied as a hybrid burner.

* * * * *